US005561508A

United States Patent [19]

Yagi

[11] Patent Number: 5,561,508

[45] Date of Patent: Oct. 1, 1996

[54] LIQUID DEVELOPING APPARATUS COMPRISING A DEVELOPMENT HEAD HAVING A RUBBING SURFACE AND A PLURALITY OF DEVELOPMENT GROOVES

[75] Inventor: Atsushi Yagi, Hachioji, Japan

[73] Assignee: Olympus Optical Co., Ltd., Tokyo, Japan

[21] Appl. No.: 400,834

[22] Filed: Mar. 8, 1995

[30] Foreign Application Priority Data

Mar. 29, 1994 [JP] Japan ..... 6-058814

[51] Int. Cl.[6] ..... G03G 15/10

[52] U.S. Cl. ..... 355/256; 118/660

[58] Field of Search ..... 355/256; 118/660, 118/645, 650; 354/318, 317

[56] References Cited

U.S. PATENT DOCUMENTS

| | | | |
|---|---|---|---|
| 3,821,931 | 7/1974 | Yamaji et al. | 101/132 |
| 4,827,309 | 5/1989 | Kato | 355/256 |
| 5,016,036 | 5/1991 | Nishikawa | 354/318 |
| 5,202,534 | 4/1993 | Tamiya et al. | 118/660 |
| 5,291,250 | 3/1994 | Nishikawa et al. | 355/256 |

FOREIGN PATENT DOCUMENTS 1-185569 7/1989 Japan .

*Primary Examiner*—Joan H. Pendegrass
*Assistant Examiner*—Quana Grainger
*Attorney, Agent, or Firm*—Frishauf, Holtz, Goodman, Langer & Chick

[57] ABSTRACT

A liquid developing apparatus includes an electrostatic recording medium, a latent image forming section for forming an electrostatic latent image on the electrostatic recording medium, a carrying section for carrying the electrostatic recording medium on which the electrostatic latent image is formed, along a predetermined carrying path, a development head provided on the carrying path and having a rubbing surface on which the electrostatic recording medium carried by the carrying means is rubbed, and a liquid developer supply section for supplying a liquid developer to the development head to develop the electrostatic latent image formed on the electrostatic recording medium. The rubbing surface has a width ranging from 1 mm to 9 mm, and the electrostatic recording medium has a smoothness (i.e., a roughness) ranging from 140 seconds to 220 seconds.

9 Claims, 6 Drawing Sheets

LIQUID DEVELOPING APPARATUS COMPRISING A DEVELOPMENT HEAD HAVING A RUBBING SURFACE AND A PLURALITY OF DEVELOPMENT GROOVES

BACKGROUND OF THE INVENTION

1. Field of the Invention

The present invention relates to a liquid developing apparatus for supplying a liquid developer to a recording sheet on which a latent image is formed, and developing tile latent image by toners of the liquid developer.

2. Description of the Related Art

Conventionally a wet recording apparatus is used to record an image on a recording sheet of a large size such as A0. The wet recording apparatus is so constructed that an electrostatic latent image is formed on the recording sheet serving as an electrostatic recording medium, and developed by bringing a liquid developer containing toners into contact with the recording sheet, thus forming an image on the recording sheet.

FIG. 1 shows a wet recording apparatus capable of recording a colored image, and this apparatus is publicly known and disclosed in Jpn. Pat. Appln. KOKAI Publication No. 1-185569. The apparatus shown in FIG. 1 includes one electrostatic recording head and a plurality of liquid development heads for respective colors. Recording paper is reciprocated between the electrostatic recording head and the liquid development heads to record a color image.

As shown in FIG. 1, an electrostatic recording paper roll 21 is constituted by applying a dielectric layer for holding an electrostatic latent image, to paper of a base. Electrostatic recording paper 20 is carried by the roll 21 in a direction I of arrow 301 (carrying direction).

A multi-stylus electrostatic recording head 22 is provided at a fixed position facing a carrying path for the electrostatic recording paper 20. The head 22 has a number of probes arranged at predetermined pitches in a direction (perpendicular to the carrying direction) crossing the carrying path of the paper 20. A pressing roller 30 for pressing the paper 20 against the head 22, is provided.

Development heads 23*a* to 23*d* constituting a liquid development unit are arranged along the carrying path of the recording paper 20. These heads supply liquid developers of different colors and, for example, the heads 23*a*, 23*b* and 23*c* supply liquid developers of cyan, magenta and yellow, respectively.

As illustrated in FIG. 2, the development head 23*a* (or each of heads 23*b* to 23*d*) includes a plurality of liquid developer supply grooves 24 on the upper surface of an elongate block-shaped substrate 23. One end of each groove 24 is connected to a corresponding one (25*a*) of liquid developer tanks 25*a* to 25*d*, and the other end is connected to a corresponding one (26*a*) of liquid developer pumps 26*a* to 26*d*. The liquid developer tanks contain liquid developers of different colors such as cyan, magenta and yellow, and are connected to their corresponding development heads 23*a* to 23*d* by means of pipes. The liquid developer pumps 26*a* to 26*d* are arranged exclusively for their respective colors, and each of them is provided at the pipe connecting its corresponding one of the development heads 23*a* to 23*d* and its corresponding one of the development tanks 25*a* to 25*d*.

Returning to FIG. 1, the electrostatic recording paper 20 sent out by the electrostatic recording paper roll 21, reciprocates. Whenever the paper 20 reciprocates, a one-colored image of a multicolored image is recorded on a print region of the paper 20, and this recording is repeated for the number of colors, thus forming a colored image. The electrostatic recording head 22 is common to the respective colors. An electrostatic latent image of one color is formed by the head 22, and then developed using a liquid developer of the color.

Consequently, in order to develop the electrostatic latent image formed on the electrostatic recording paper 20, one of the development heads 23*a* to 23*d*, corresponding to the color of the latent image, is lifted up to the carrying path of the recording paper 20 and placed into contact with the paper 20. The other development heads corresponding to the other colors stand by under the carrying path. When the development head contacts the carrying path of the paper 20, the development pump corresponding to the head is operated. The recording paper is thus attracted to the development head by negative pressure generated by the development pump.

If the development head 23*a* rises to a carrying position of the recording paper 20, the liquid developer pump 26*a* is operated to cause attraction in the liquid developer supply grooves 24 of the head 23*a*. Then the recording paper 20 is attracted to the upper surface of the development head 23*a* by the negative pressure caused by the attraction to stop an opening of the head 23*a*. Therefore, the negative pressure in the head 23*a* is increased, and a liquid developer is pumped up from the liquid developer tank 25*a* and supplied to the liquid developer supply grooves 24. The liquid developer is returned from the development head 23*a* to the tank 25*a* through the liquid developer pump 26*a*.

The recording paper 20 attracted to the grooves 24 is carried through the carrying path in contact with the liquid developer in the grooves 24, with the result that an electrostatic latent image is developed.

When the development of the image of a specified color is completed, the development head 23*a* separates from the recording paper 20 and lowers to a position under the carrying path of the recording paper 20. Part of the liquid developer supplied to the development head 23*a*, remains on the surface of the paper 20. A squeeze head 27 is provided to remove the remaining liquid developer and dehydrate the paper 20. The squeeze head 27 is connected to a waste-liquid tank 29 through its dedicated vacuum pump 28. When the vacuum pump 28 is operated, the remaining liquid developer is removed from the recording paper 20 by the negative pressure generated by the vacuum pump 28, and collected in the waste-liquid tank 29.

In FIG. 1, reference numeral 31 indicates a liquid developer concentration detecting device, 32 denotes a high-concentration developer tank for replenishing the liquid developer with high-concentration toners to maintain the constant concentration of the developer, 33 shows an electromagnetic valve to be opened in response to a signal output from the device 31, and 34 represents a vacuum switch.

The liquid developing apparatus having the above constitution is of a multi-stylus electrostatic recording type wherein the multi-stylus electrostatic recording head is employed to record a latent image on the electrostatic recording paper 20. Since, in this apparatus, an electrostatic latent image is formed by discharge caused between the recording paper 20 and the probes, a slight gap is required between the surface of the paper and the probes.

The gap is maintained by particles buried in the surface region of the recording paper 20. However, the unevenness of the paper due to the particles, prevents toners from being uniformly attached to the electrostatic latent image formed on the recording paper 20. In particular, the toners are not attached to the convex portion of the paper, with the result that a formed image includes a subtly white portion, and this portion deteriorates the image.

The smoothness of the surface of the recording paper 20 is decreased (i.e., the roughness is increased) since the surface is uneven and, as a result, discharge is generated. Therefore, a large amount of air may flow into the grooves 24 to generate air bubbles therein and, in this case, a latent image is not partially formed on the recording paper 20 because of the air bubbles, thus causing irregularities in the image.

SUMMARY OF THE INVENTION

An object of the present invention is to provide a liquid developing apparatus capable of uniform image density.

This object is attained by a liquid developing apparatus comprising:

an electrostatic recording medium;

a latent image forming section for forming an electrostatic latent image on the electrostatic recording medium;

a carrying section for carrying the electrostatic recording medium on which the electrostatic latent image is formed, along a predetermined carrying path;

a development head provided on the carrying path and having a rubbing surface on which the electrostatic recording medium carried by the carrying section is rubbed; and a liquid developer supply section for supplying a liquid developer to the development head to develop the electrostatic latent image formed on the electrostatic recording medium, the rubbing surface having a width ranging from 1 mm to 9 mm, and the electrostatic recording medium having smoothness ranging from 140 seconds to 220 seconds.

According to the present invention, the liquid developer supply section is operated when the surface of the development head on which the development grooves are formed is covered with the electrostatic recording medium, the development grooves are set in the negative pressure state, and the recording medium closely contacts the surface of the development head. In this state, the liquid developer is supplied to the development grooves to develop the electrostatic latent image on the electrostatic recording medium.

Since the width of each of the rubbing surfaces, which is formed at the upstream and downstream edges of the development head in the carrying direction of the electrostatic recording medium, is set to the range from 1 mm to 9 mm, and the smoothness of the electrostatic recording medium is set to the range from 140 seconds to 220 seconds, the amount of air flowing from between the rubbing surfaces and recording medium into the development grooves can be set to the optimum value, and the liquid developer remaining on the surface of the recording medium can be reliably eliminated.

According to the present invention, an air groove is formed on the surface of the development head along the development grooves to supply air between the surface of the development head and the electrostatic recording medium. The liquid developer remaining between them can be collected effectively in the development grooves, together with the air.

According to the present invention, the liquid developer supply section is provided with an attraction pump. Since the negative pressure of the development grooves is set to a range from −250 mmHg to −350 mmHg by the attraction pump, the liquid developer can be supplied to the electrostatic recording medium appropriately, and the surplus liquid developer can be removed.

According to the present invention, since the electrostatic latent image is recorded on the electrostatic recording medium by controlling an ion current, a discharging gap due to the irregularities of the surface of the electrostatic recording medium need not be considered. Therefore, the electrostatic latent image can be recorded satisfactorily on the surface of the recording medium whose smoothness is 140 seconds or more.

According to the present invention, if the recording medium of high smoothness is employed, the contact between the medium and the rubbing surfaces is improved, and the amount of unnecessary air flowing into the development grooves can be decreased. Consequently, toiler particles can be uniformly attached to the latent image, and the unevenness of image density, which is caused by the air bubbles flowing through the development grooves, can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENT

Figure 1:
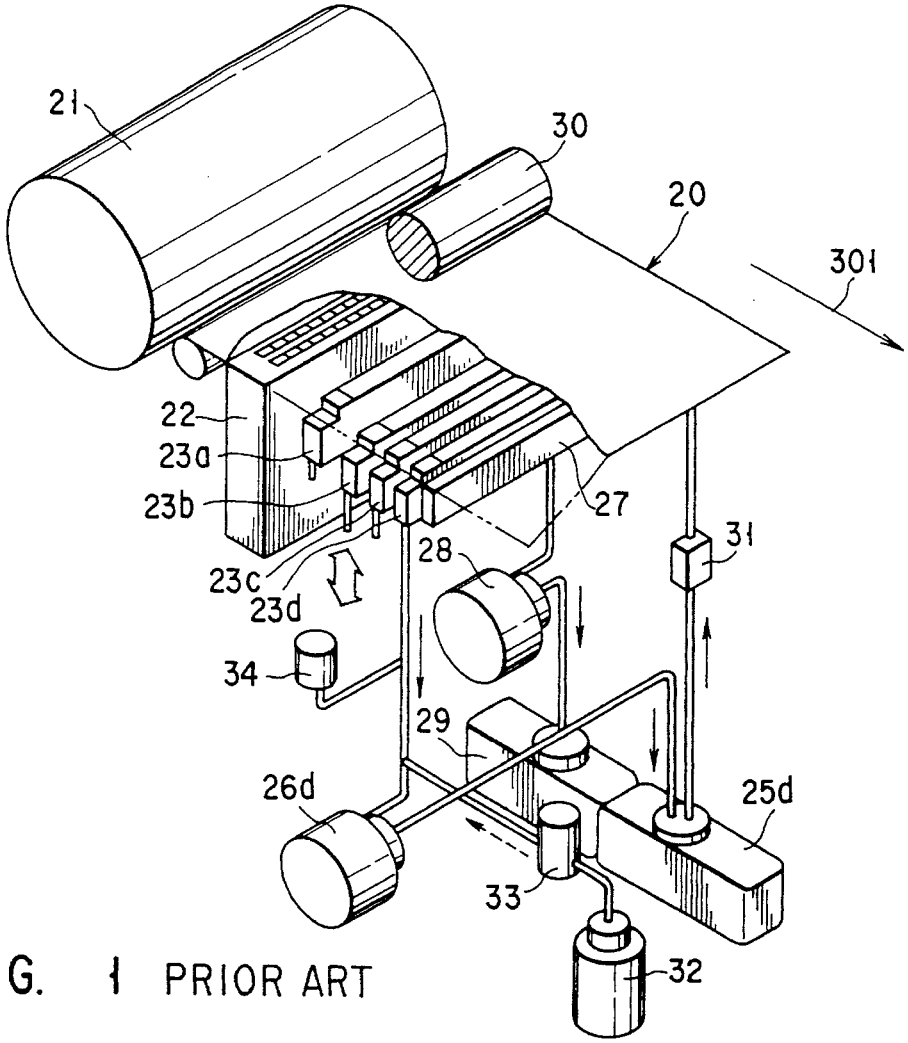
FIG. 1 PRIOR ART
FIG. 1 is a schematic view showing a constitution of a conventional wet recording apparatus.
Figure 2:
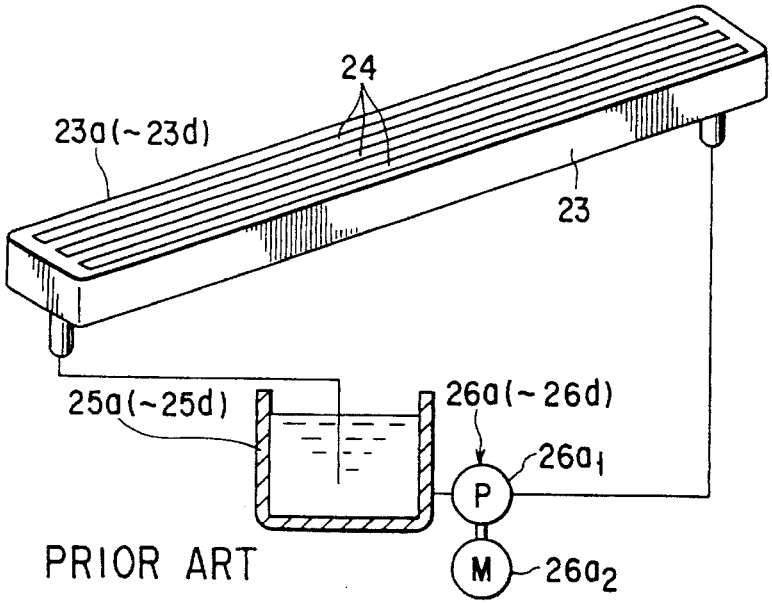
FIG. 2 PRIOR ART
FIG. 2 is a schematic view showing a constitution of a conventional liquid developing apparatus.
Figure 3:
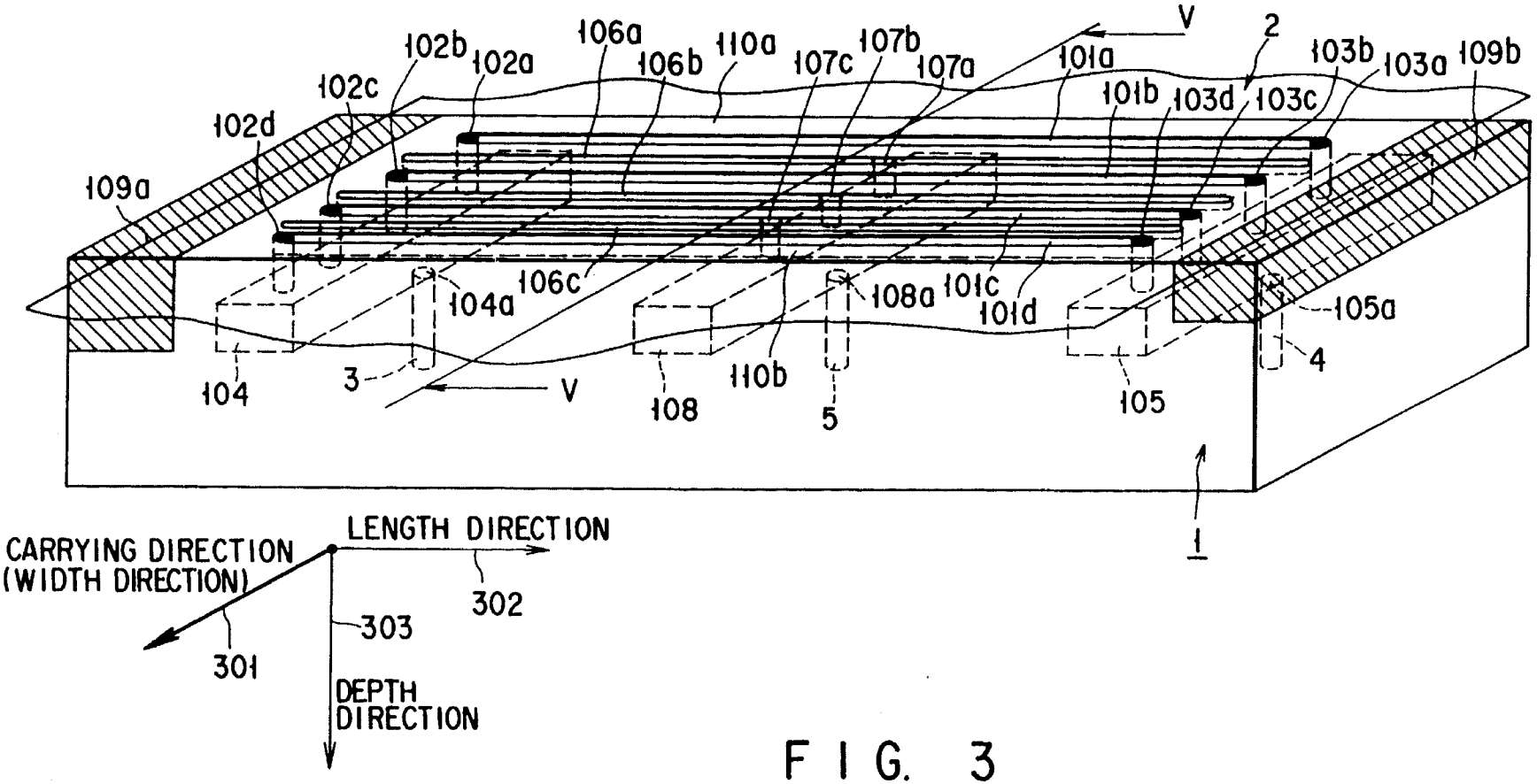
FIG. 3 is a perspective view of a development head used in a liquid developing apparatus according to an embodiment of the present invention.
Figure 4:
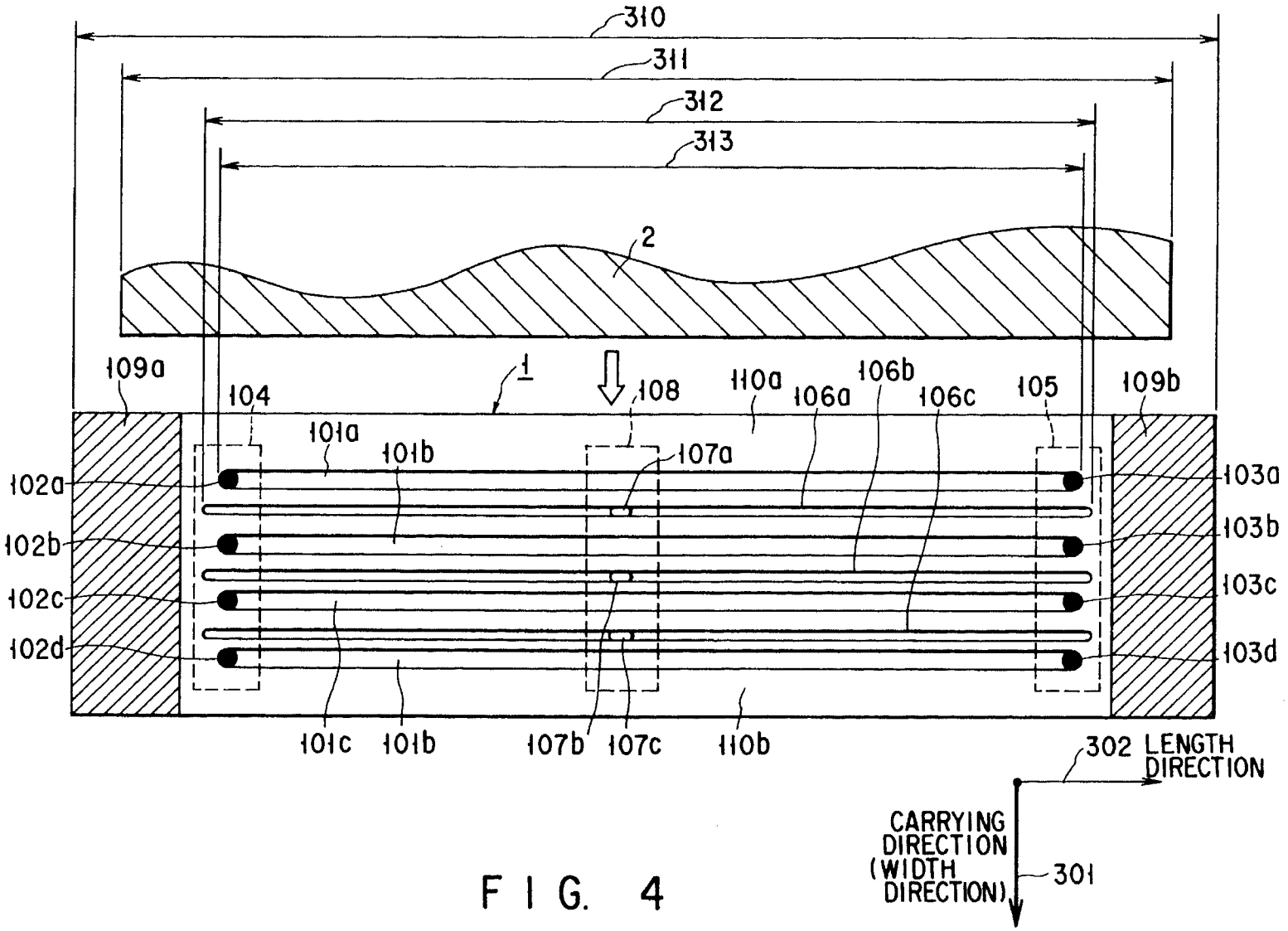
FIG. 4 is a plan view of the development head shown in FIG. 3.

A liquid developing apparatus according to an embodiment of the present invention includes a number of elements equivalent to those shown in FIGS. 1 and 2 as well as a development head 1 shown in FIGS. 3 and 4. Since the elements shown in FIG. 1 and 2 have been described in detail, their descriptions are omitted here, and the development head 1, which is a characteristic element of the liquid developing apparatus of the present invention, will now be described in detail, with reference to FIGS. 3 and 4.

As illustrated in FIGS. 3 and 4, the development head 1 is shaped like a rectangular parallelepiped, and its width 310 is set greater than that 311 of a recording sheet 2. The upper surface of the head 1 is flush with a carrying path of the recording sheet 2. A plurality of slit-like development grooves 101*a* to 101*d* are arranged on the upper surface of the development head 1 in a direction (length direction 302) crossing the carrying path of the sheet 2, that is, along the longitudinal direction of the head 1. The width of each of the development grooves 101*a* to 101*d* is about 2 mm, and the depth thereof is also about 2 mm. Both ends of these grooves are provided with liquid developer supply ports 102*a* to 102*d* and liquid developer discharge ports 103*a* to 103*d*, each having a diameter of approximately 2 mm. The length 313 of each of the development grooves 101*a* to 101*d* is set smaller than the width 311 of the recording sheet 2.

A liquid developer supply chamber 104 is formed in the development head 1 so as to communicate with the liquid developer supply ports 102*a* to 102*d*. Similarly, a liquid developer discharge chamber 105 is formed therein so as to communicate with the liquid developer discharge ports 103*a* to 103*d*. A pipe 3 is connected to an opening 104*a* of the chamber 104, while a pipe 4 is connected to an opening 105*a* of the chamber 105.

Air grooves 106*a* to 106*c* are formed on the upper surface of the development head 1 such that each of them is interposed between the grooves 101*a* to 101*d*. The width of each air groove is about 1 mm, and the depth thereof is about 2 mm. Therefore, the width of each air groove is smaller than that of each development groove. The length 312 of each air groove is smaller than the width 311 of the recording sheet 2 and larger than the length 313 of each development groove.

Furthermore, air supply ports 107*a* to 107*c* are provided in the middle of their respective air grooves 106*a* to 106*c* in the longitudinal direction thereof. These air supply ports 107*a* to 107*c* communicated with an air supply chamber 108 formed in the development head 1. A pipe 5 is connected to an opening 108*a* of the air supply chamber 108.

The development head 1 is formed of aluminum, and its surface is plated with two layers of nickel and chromium and finished like a mirror in order to prevent wear from being caused in a portion contacting the recording sheet 2. Insulating members 109*a* and 109*b* are provided at the upper ends of the development head 1 in the longitudinal direction thereof, and their surfaces are flush with a middle portion of the head 1.

Figure 5:
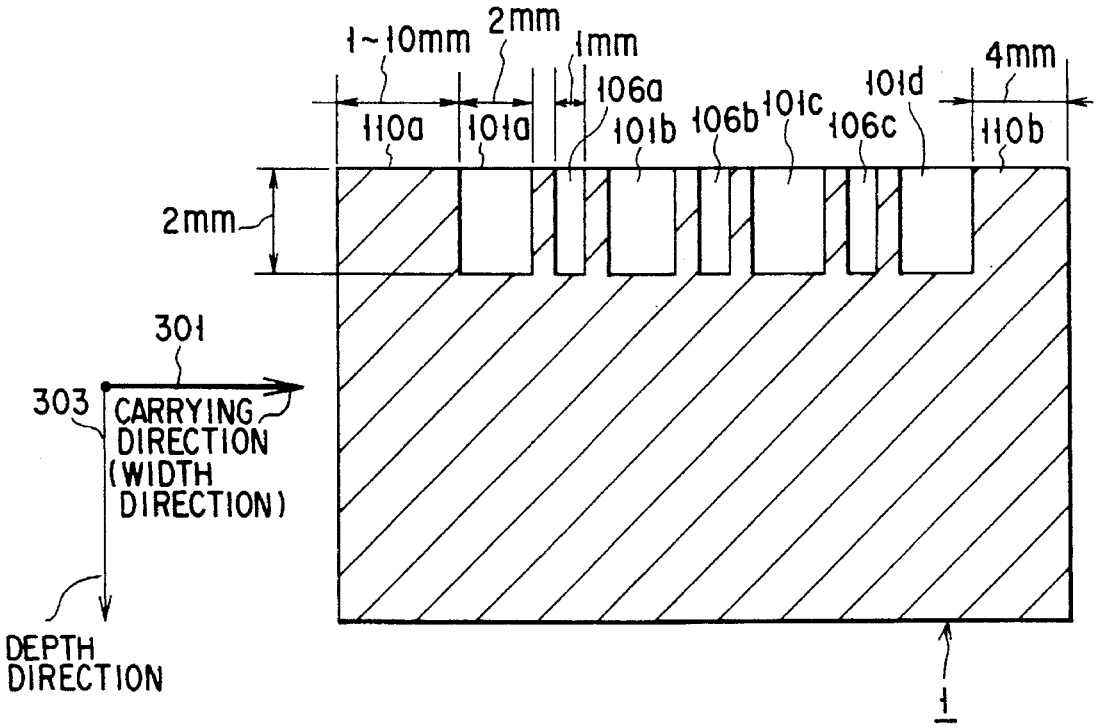
FIG. 5 is a cross-sectional view taken along the line V—V of FIG. 3.

Referring to FIG. 5, the section of the development head 1 can be easily understood. In FIG. 5, the head 1 includes a development head rubbing surface 110*a* having a width of 1 to 10 mm on the upstream side in a recording sheet carrying direction 301, and a development head rubbing surface 110*b* having a width of 1–12 mm on the downstream side therein. Between these surfaces 110*a* and 110*b*, the foregoing four development grooves 101*a* to 101*d* and three air grooves 106*a* to 106*c* are arranged at intervals of 1 mm. The recording sheet 2 is carried along the upper surface of the head 1 so as to contact the rubbing surfaces 110*a* and 110*b*.

Figure 6:
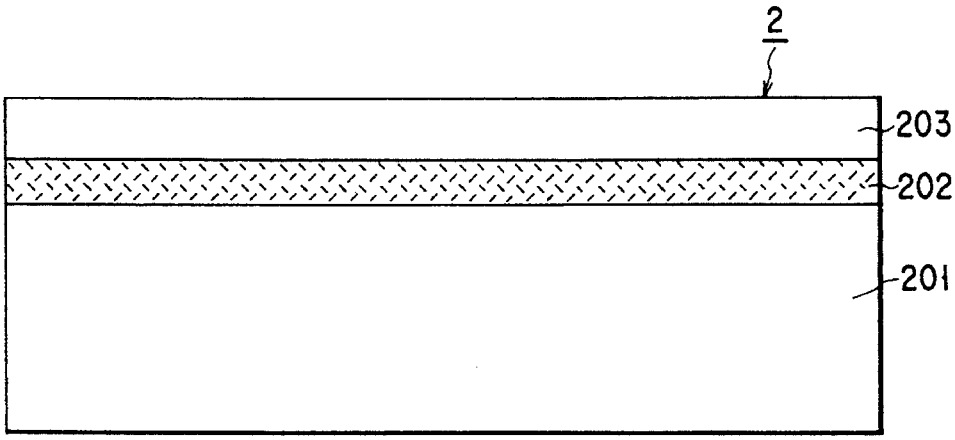
FIG. 6 is a cross-sectional view of a recording sheet used in the liquid developing apparatus according to the embodiment of the present invention.

FIG. 6 is a cross-sectional view of the recording sheet 2. As shown in FIG. 6, the recording sheet 2 has a three-layered structure of base paper 201, a conductive layer 202 and a dielectric layer 203 so that an electrostatic latent image can be recorded and held. The dielectric layer 203 is charged to record the electrostatic latent image, and its surface has irregularities of several micrometers, thereby keeping a slight gap between the dielectric layer 203 and the development head rubbing surfaces 110*a* and 110*b* of the mirror-finished development head 1.

Figure 7:
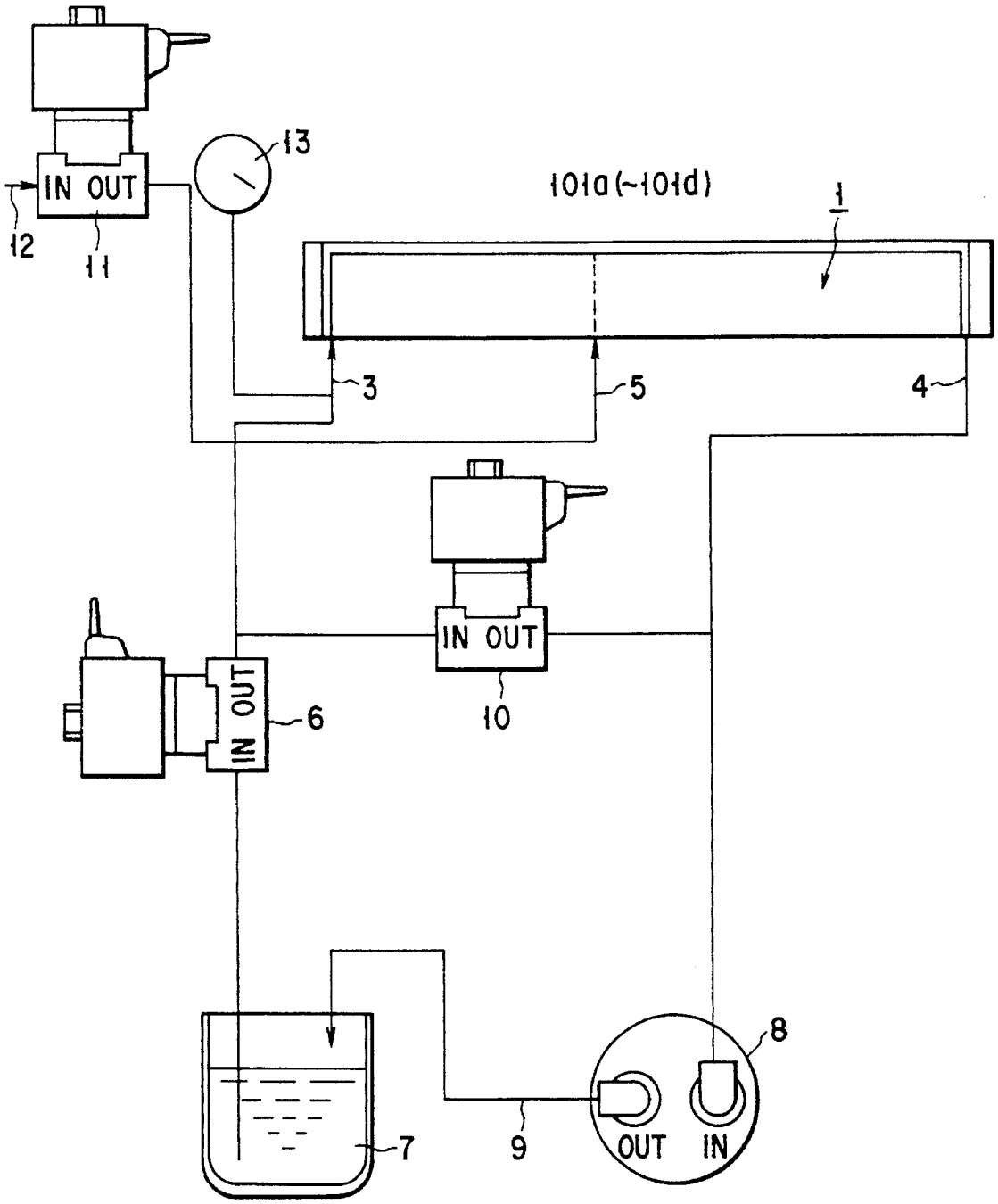
FIG. 7 is a schematic view showing a constitution of a liquid developer supply means used in the liquid developing apparatus according to the embodiment of the present invention.

FIG. 7 shows a liquid developer supply unit for supplying a liquid developer to the development head 1 having the above constitution. A liquid developer container 7 is connected to the pipe 3 extending from the development head 1, via an electromagnetic valve 6, while an attraction pump 8 is connected to the pipe 4 extending from the head 1 and to the container 7 via a pipe 9. The pipes 3 and 4 are connected to each other through an electromagnetic valve 10. The pump 8 generates negative pressure in the development head 1, and the negative pressure falls within a range from −250 mmHg to −350 mmHg when a liquid developer circulation system is closed tightly.

An air introduction pipe 12 is connected to the pipe 5 extending from the head 1, via an electromagnetic valve 11.

In FIG. 7, reference numeral 13 indicates a pressure gauge for monitoring the pressure of the liquid developer supplied from the liquid developer container 7 to the development head 1.

An operation of the liquid developing apparatus having the above constitution, will now be described.

When the recording sheet 2 is placed on the development head 1, the electromagnetic valve 6 is opened, and the electromagnetic valves 10 and 11 are closed. The attraction pump 8 is thus operated to pump air out of the liquid developer discharge chamber 105 in the development head 1 through the pipe 4; accordingly, air in the development grooves 101*a* to 101*d* is caused to flow into the chamber 105 through the liquid developer discharge ports 103*a* to 103*d*.

The pressure in the development grooves 101*a* to 101*d* is decreased, and the recording sheet 2 is attracted to the upper surface of the development head 1. When the recording sheet 2 closely contacts the upper surface of the head 1, the air in the liquid developer supply chamber 104 and pipe 3 is pumped out from the liquid developer supply ports 102*a* to 102*d* to thereby generate a negative pressure. In this state, the liquid developer in the liquid developer container 7 flows through the electromagnetic valve 6 and the pipe 3 into the liquid developer supply chamber 104 from the opening 104*a* thereof.

Then the liquid developer flows from the chamber 104 into the respective development grooves 101*a* to 101*d* via the liquid developer supply ports 102*a* to 102*d*. The developer flows from the liquid developer discharge ports 103*a* to 103*d* into the liquid developer discharge chamber 105, and is discharged from the opening 105*a* to the pipe 4. The discharged developer is returned to the liquid developer container 7 through the pipe 9 by means of the attraction pump 8.

In the foregoing operation, if the recording sheet 2 on which an electrostatic latent image is recorded, is carried onto the development head 1, toners are attached to the latent image on the sheet 2, and the latent image is visualized.

The development grooves 101*a* to 101*d* are almost filled with the liquid developer and set in the negative pressure state. Therefore, air is caused to flow into the development grooves 101*a* to 101*d* from a slight gap between the surface of the recording sheet 2 and the rubbing surfaces 110*a* and 110*b* of the development head.

When the development on the recording sheet 2 is completed, the liquid developer remaining on the sheet 2 is collected into the development grooves 101*a* to 101*d*, as is the air flowing from the slight gap. The surface of the sheet 2 is thus dehydrated and separated from the development head 1.

The amount of air flowing into the development grooves 101*a* to 101*d* depends upon the negative pressure in the development grooves, the width of the rubbing surfaces 110*a* and 110*b* of the development head, the smoothness of the surface of the recording sheet 2, and the like. If the amount of air is large, air bubbles flow through the grooves, and part of an electrostatic latent image is not developed, thus causing unevenness in a formed image. If the amount of air is small, the surplus liquid developer remaining on the recording sheet 2 is not eliminated, and the sheet 2 with the liquid developer is discharged as it is or a toner image loses its shape, resulting in deterioration in a formed image.

When the development on the recording sheet 2 is completed, the electromagnetic valve 6 is closed, while the electromagnetic valve 10 is opened. Since the valve 6 is closed, a new liquid developer is not supplied from the liquid developer container 7. If, in this state, the attraction pump 8 is operated, the liquid developer in the development grooves 101*a* to 101*d* flows through the pipe 4 and valve 10 into the pipe 3. The liquid developer in the liquid developer discharge chamber 105 also flows through the pipe 4 and is collected.

The liquid developer remaining on the recording sheet 2 is collected in the development grooves 101*a* to 101*d* by the air flowing from between the recording sheet 2 and the rubbing surfaces 110*a* and 11*b* of the development head.

If the electromagnetic valve 11 is opened, the air introduced from the air introduction pipe 12, flows from the air supply chamber 108 into the air grooves 106*a* to 106*c* through the air supply ports 107*a* to 107*c*. In this case, the development grooves 101*a* to 101*d* are set in the negative pressure state, and the distance between each of the development grooves and each of the air grooves is 1 mm and short, with the result that air flows from the air grooves into the development grooves. The liquid developer remaining between the upper surface of the head 1 and the recording sheet 2 is collected in the development grooves, together with the air. In this state, even though the head 1 is separated from the recording sheet 2, the sheet 2 can be rewound for recording an image of the next color, since the surface of the sheet 2 is dehydrated.

The amount of air flowing into the development grooves 101*a* to 101*d*, which varies the states of the development and affects those of images, depends upon the width of the rubbing surfaces 110*a* and 110*b* of the development head and the smoothness of the surface of the recording sheet 2. The smoothness (or roughness) can be expressed by measured values of the Bekk tester. The Bekk tester measures a period of time (seconds) required for air of 10 ml passing between the surface of a paper strip and, the standard surface of optically polished glass with a difference in prescribed pressure between them.

Figure 8:
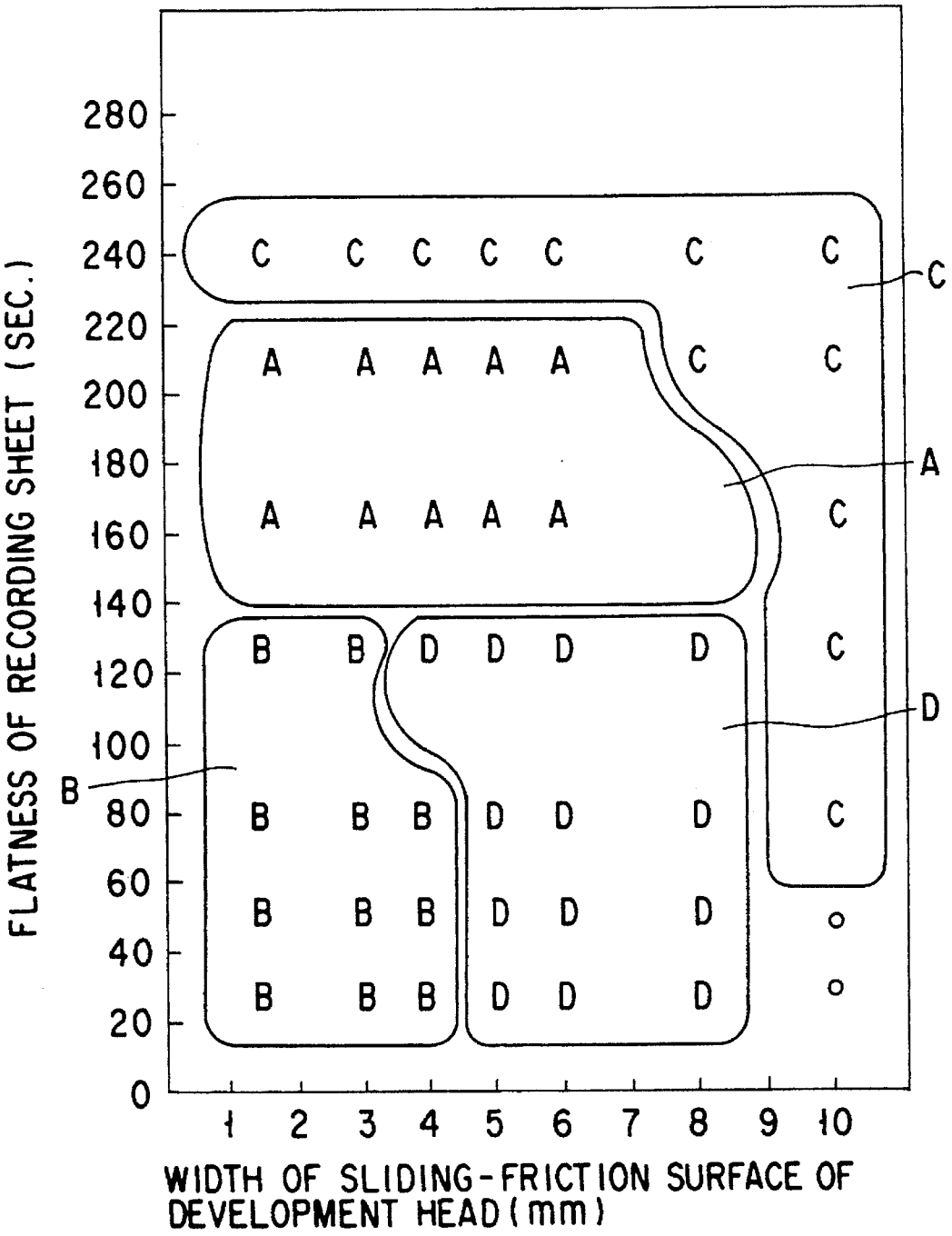
FIG. 8 is a diagram for explaining the liquid developing apparatus according to the embodiment of the present invention.

FIG. 8 shows the states of images on condition that the width of each of the rubbing surfaces 110*a* and 110*b* of the development head 1 varies from 1 mm to 10 mm and the smoothness of the recording sheet 2 varies from 25 seconds to 240 seconds.

In FIG. 8, an area B indicates that the smoothness of the sheet 2 is low, the width of each rubbing surface is small, and the amount of air flowing into the development grooves 101*a* to 101*d* is large. In this area B, since a large amount of air bubbles flow through the development grooves, part of a latent image is not developed, resulting in unevenness in image density.

An area C indicates that the smoothness of the recording sheet 2 is high and the width of the rubbing surfaces 110*a* and 110*b* is great. In this area C, the amount of air flowing from between the rubbing surfaces into the development grooves 101*a* to 101*d* is small, and the liquid developer remaining on the surface of the sheet 2 is not removed. Therefore, the recording sheet 2 with the liquid development is discharged as it is, and an image loses its shape because of unfixed toners, or the like.

An area D does not have the above problems of the areas B and C. If, however, the smoothness of the recording sheet 2 is 120 seconds or less, the irregularities of the surface of the sheet 2 become great, and no toner particles are attached to the tops of the irregularities. Consequently, a formed image includes a subtly white portion and thus deteriorates.

In contrast, an area A where the width of each of the rubbing surfaces 110*a* and 110*b* ranges from 1 mm to 9 mm and the smoothness (i.e., roughness) of the recording sheet 2 ranges from 140 seconds to 220 seconds, does not have the problems of the above areas B, C and D, and a good image can be formed. In FIG. 8, the area A is shaped like a trapezoid by the lines connecting four points at which the width is 1 mm and smoothness is 220 seconds, the width is 1 mm and smoothness is 140 seconds, the width is 9 mm and smoothness is 140 seconds, and the width is 7 mm and smoothness is 220 seconds.

According to the above embodiment, if the recording sheet 2 is carried to the development grooves 101*a* to 101*d* formed on the surface of the development head 1 and these grooves are set in the negative pressure state by the attraction pump 8, the recording sheet 2 closely contacts the surface of the development head 1 and, in this state, a liquid developer is supplied from the liquid developer container 7 to the grooves 101*a* to 101*d* to develop an electrostatic latent image formed on the recording sheet. Since the width of each of the rubbing surfaces 110*a* and 110*b*, formed at the upstream and downstream edges of the development head 1 in the carrying direction, is set to a range from 1 mm to 9 mm, and the smoothness of the recording sheet 2 is set to a range from 140 seconds to 220 seconds, the optimum amount of air is caused to flow from a gap between the rubbing surfaces 110*a* and 110*b* and the recording sheet 2 into the development grooves 101*a* to 101*d*. Therefore, the liquid developer remaining on the surface of the recording sheet 2 can reliably be eliminated to prevent unevenness from being caused in development and to prevent an image from losing its shape or from being dirtied because of unfixed toners. In addition, since toner particles can be uniformly attached to the surface of the recording sheet 2, a good image free of unevenness can be formed.

Since, furthermore, the air grooves 106*a* to 106*c* are each formed between the development grooves 101*a* to 101*d* to supply air between the upper surface of the development head 1 and the recording sheet 2, the liquid developer remaining therebetween after the development, can be collected effectively in the development grooves 101*a* to 101*d*, together with the air. Consequently, the drawbacks wherein the recording sheet 2 with the liquid developer is discharged and the toner image loses its shape, can be eliminated.

Since the negative pressure can be set in the development grooves 101*a* to 101*d* by the attraction pump 8 with a range from −250 mmHg to −350 mmHg, the liquid developer can be appropriately supplied to the recording sheet 2, and the surplus liquid developer can be removed. Thus, even though a high negative pressure is generated, the developed toner image does not lose its shape, nor is it dirtied by the development. If the negative pressure is low, the surplus liquid developer is not removed, with the result that the recording sheet 2 with the developer is discharged as it is, and the image is not fixed. Such problems can be eliminated if the negative pressure of the attraction pump 8 is controlled so as to fall within the above range.

In the liquid developing apparatus according to the above embodiment, an electrostatic latent image can be recorded on the electrostatic recording sheet by controlling an ion current. If the ion current is controlled, the electrostatic latent image can be recorded satisfactorily on the surface of the recording sheet whose smoothness is 140 seconds or more, since a discharging gap due to the irregularities of the surface of the electrostatic recording sheet need not be considered. Furthermore, if the recording sheet of high smoothness is employed, the contact between the sheet and the rubbing surfaces is improved, and the amount of unnecessary air flowing into the development grooves can be decreased. Consequently, toner particles can be uniformly attached to the latent image, and the unevenness of image density, which is caused by the air bubbles flowing through the development grooves, can be prevented.

As described above, according to the liquid developing apparatus of the present invention, since the width of each of the rubbing surfaces is set to the range from 1 mm to 9 mm, and the smoothness of the electrostatic recording sheet is set to the range from 140 seconds to 220 seconds, the amount of air flowing from between the rubbing surfaces and recording sheet into the development grooves can be set to the optimum value, and the liquid developer remaining on the surface of the recording sheet can be reliably eliminated. Moreover, since the toners can be uniformly attached to the recording sheet, an image with a uniform density can be formed.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A liquid developing apparatus comprising:

an electrostatic recording medium;

latent image forming means for forming an electrostatic latent image on said electrostatic recording medium;

carrying means for carrying along a predetermined carrying path said electrostatic recording medium on which the electrostatic latent image is formed;

a development head provided on the carrying path and having a rubbing surface on which said electrostatic recording medium carried by said carrying means is rubbed, said development head including a plurality of development grooves crossing the carrying path, and said rubbing surface being formed adjacent to the plurality of development grooves on at least one of upstream and downstream sides of the plurality of development grooves along the carrying path; and liquid developer supply means for supplying a liquid developer to said development head to develop the electrostatic latent image formed on said electrostatic recording medium;

said liquid developer supply means including means for generating a negative pressure inside said plurality of development grooves for attracting said electrostatic recording medium to said development head, and means for supplying the liquid developer to said plurality of development grooves; and wherein said rubbing surface has a width ranging from 1 mm to 9 mm, and said electrostatic recording medium has a smoothness ranging from 140 seconds to 220 seconds.

2. The liquid developing apparatus according to claim 1, wherein said development head further includes an air groove which is formed in said development head along said plurality of development grooves, for supplying air between the development head and said electrostatic recording medium.

3. The liquid developing apparatus according to claim 2, wherein said air groove includes means for causing a predetermined amount of air to flow between said development head and said electrostatic recording medium to said development grooves, said predetermined amount of air being defined by a negative pressure generated inside said plurality of development grooves, the width of the rubbing surface, and the smoothness of said electrostatic recording medium.

4. The liquid development apparatus according to claim 2, wherein a width of said air groove is smaller than a width of each of said plurality of development grooves, a depth of said air groove is about 2 mm, and a length of said air groove is smaller than a width of said electrostatic recording medium and larger than a length of each of said plurality of development grooves.

5. The liquid developing apparatus according to claim 2, wherein a distance between said air groove and each of said plurality of development grooves is about 1 mm.

6. The liquid developing apparatus according to claim 1, wherein said liquid developer supply means includes an attraction pump for generating said negative pressure inside said plurality of development grooves, the negative pressure being set to a range from −250 mmHg to −350 mmHg.

7. The liquid developing apparatus according to claim 1, wherein said latent image forming means includes means for controlling an ion current.

8. The liquid developing apparatus according to claim 1, wherein, in a characteristic diagram whose ordinate and abscissa represent the smoothness of said electrostatic recording medium and the width of said rubbing surface, respectively, the width and the smoothness fall within a range corresponding to a trapezoidal region defined by a first point at which the width is 1 mm and the smoothness is 220 seconds, a second point at which the width is 1 mm and the smoothness is 140 seconds, a third point at which the width is 9 mm and the smoothness is 140 seconds, and a fourth point at which the width is 9 mm and the smoothness is 220 seconds.

9. A liquid developing apparatus comprising:

an electrostatic recording medium;

latent image forming means for forming an electrostatic latent image on said electrostatic recording medium;

carrying means for carrying along a predetermined carrying path said electrostatic recording medium on which the electrostatic latent image is formed;

a development head provided on the carrying path and having a rubbing surface on which said electrostatic recording medium carried by said carrying means is rubbed; and liquid developer supply means for supplying a liquid developer to said development head to develop the electrostatic latent image formed on said electrostatic recording medium, wherein said rubbing surface has a width ranging from 1 mm to 9 mm, and said electrostatic recording medium has a smoothness ranging from 140 seconds to 220 seconds, and wherein, in a characteristic diagram whose ordinate and abscissa represent the smoothness of said electrostatic recording medium and the width of said rubbing surface, respectively, the width and the smoothness fall within a range corresponding to a trapezoidal region approximately defined by a first point at which the width is 1 mm and the smoothness is 220 seconds, a second point at which the width is 1 mm and the smoothness is 140 seconds, a third point at which the width is 9 mm and the smoothness is 140 seconds, and a fourth point at which the width is 9 mm and the smoothness is 220 seconds.

* * * * *